US006095899A

United States Patent [19]

Elmar et al.

[11] Patent Number: 6,095,899

[45] Date of Patent: Aug. 1, 2000

[54] APPARATUS AND METHOD FOR MACHINING WORKPIECES BY FLUSHING WORKING LIQUID TO THE TOOL-AND-WORKPIECE INTERFACE

[75] Inventors: Wittenzellner Elmar, Munich, Germany; Kenichi Sekiya, Tokyo, Japan

[73] Assignee: Disco Corporation, Tokyo, Japan

[21] Appl. No.: 09/124,753

[22] Filed: Jul. 29, 1998

[30] Foreign Application Priority Data

Aug. 15, 1997 [JP] Japan ..... 9-220406
Mar. 5, 1998 [JP] Japan ..... 10-053193

[51] Int. Cl.[7] ..... B24B 1/00

[52] U.S. Cl. ..... 451/28; 451/65; 451/41

[58] Field of Search ..... 451/65, 66, 41, 451/57, 285, 288, 290, 28, 292, 332

[56] References Cited

U.S. PATENT DOCUMENTS 4,445,300 5/1984 Sekiya et al. ..... 451/41
4,663,890 5/1987 Brandt ..... 451/41
5,297,365 3/1994 Nishioka et al. ..... 451/57 X
5,308,438 5/1994 Cote et al. ..... 156/636
5,667,424 9/1997 Pan ..... 451/41 X
5,702,291 12/1997 Isobe ..... 451/41

*Primary Examiner*—David A. Scherbel
*Assistant Examiner*—Anthony Ojini
*Attorney, Agent, or Firm*—Arent Fox Kintner Plotkin & Kahn, PLLC

[57] ABSTRACT

Disclosed are improved apparatus and method for effecting a required machining on workpieces with working liquid flushing to the tool-and-workpiece contacting place. Gas such as air is ejected to the tool-and-workpiece contacting place, thereby making the working liquid to forcedly invade into the tool-and-workpiece interface. Thus, cooling effect is enhanced to maximum while saving the quantity of working liquid, still assuring that the products of comparable or even higher quality are provided.

1 Claim, 9 Drawing Sheets

APPARATUS AND METHOD FOR MACHINING WORKPIECES BY FLUSHING WORKING LIQUID TO THE TOOL-AND-WORKPIECE INTERFACE

BACKGROUND OF THE INVENTION

1. Field of the Invention

The present invention relates to a machining method in which a required machining is effected on a workpiece by holding the workpiece firmly with the aid of holding means and by putting a working tool in contact with the workpiece thus firmly held. Also, the present invention relates to a machining apparatus using such a machining method.

2. Description of Related Art

In a variety of such machining apparatuses a working or machining liquid is directed to the place at which the working tool is put in contact with the workpiece, thereby cooling the working tool-and-workpiece contacting area to improve the machining precision and the quality of the finished products.

FIG. 14 shows one example of such a machining apparatus. It is a dicing apparatus 50 for dicing semiconductor wafers "W". As seen from FIG. 15, a semiconductor wafer "W" is held in a frame "F" with the aid of holding tape "T", and a plurality of so framed semiconductor wafers are contained in a cassette 71.

Each semiconductor wafer "W" has lateral and longitudinal linear passage "S" forming a lattice pattern to define a plurality of rectangular areas, each having a circuit pattern formed thereon.

The semiconductor wafers "W" are transferred from the cassette 71 to a tentative storage place 73 one after another by transporting means 72. Another transporting means 74 sucks a selected framed semiconductor wafer "W" by applying a negative pressure thereto, and then it turns to bring the framed semiconductor wafer "W" from the tentative storage place 73 to a chuck table 58, putting the framed semiconductor wafer "W" thereon. Then, the framed semiconductor wafer "W" is sucked and held there with a negative pressure applied thereto.

Then, the chuck table 58 is moved in the X-direction to put the framed semiconductor wafer "W" just below an alignment unit 75 for detecting each of the lateral and longitudinal linear passage "S", which are to be cut according to the pattern matching process. The chuck table 58 is moved forward again in the X-direction to a cutting station, in which a cutter unit 77 cuts the semiconductor wafer "W" along each and every linear passage "S" with its cutting blade 76 while being supplied with a cutting liquid as a working liquid. Thus, the semiconductor wafer "W" is diced by cutting the lateral and longitudinal linear passage one by one and separated into a plurality of chips.

Referring to FIG. 16, the cutter unit 77 has its cutting blade 76 covered with a blade cover 78. The cutting blade 76 has agglomeration of abrasive grain on its circumference 79 formed with pulverized diamond et al by electro forming. Also, the cutter unit 77 has a spindle 81 rotatably supported in a spindle housing 80 and a pair of nozzles 82*a* and 82*b* to sandwich the cutting blade 76 therebetween, as shown in FIG. 17. The cutting blade 76 is fixed to the end of the spindle 81. The nozzles 82*a* and 82*b* direct the working liquid to the opposite sides of the cutting blade 76 at the rate of about two liters per minute for cooling the semiconductor wafer "W".

Even though the whole surface of the semiconductor wafer "W" has been wet with the working liquid, and in spite of the continuous supplying of the working liquid to the blade-and-wafer contacting place the semiconductor wafer "W" cannot be cooled well. As a result it is likely to cause cracks or chippings at the edges of the chips made by dicing, thus deteriorating the quality of the finished chips and lowering the machining precision.

Also disadvantageously, a lot of working liquid must be supplied to wash debris away from the cutting area. Disposal of the so contaminated liquid waste despoils the environment.

Lest an insufficient amount of working liquid should be supplied to the wafer-and-blade contacting place an excessive amount of working liquid, which is much more than needed, is liable to be wasted. With a view to improve the quality of finished chips distilled water is used, and the wasting of such an expensive working liquid is disadvantageous from the point of economical view.

Not only the semiconductor wafer dicing apparatus but also any other machining apparatuses using a working liquid continuously flushing to the workpiece-and-blade contacting place have the above described problems in common. Thus, there has been an increasing demand for saving the working liquid without lowering the machining precision and the quality of finished products.

SUMMARY OF THE INVENTION

To meet such a demand a machining apparatus according to the present invention comprises: holding means for holding a workpiece to be machined; machining means having a working tool put in contact. with the workpiece held by the holding means for effecting a required machining; working liquid supplying means for directing a working liquid to the place at which the working tool is put in contact with the workpiece; and gas ejecting means for ejecting a gas toward the workpiece in such a way that the working liquid may forcedly invade into the working tool-and-workpiece contacting area.

The working tool may comprise an agglomeration of abrasive grain, and the agglomeration of abrasive grain may function as a whetstone. The holding means may be a chuck table. The required machining may be to grind a workpiece. The workpiece may be a semiconductor wafer. The working liquid may be water, and the gas ejected from the gas ejecting means may be air.

The agglomeration of abrasive grain may be a cutting blade, and then the machining means may be a cutting means.

A machining method in which a required machining is effected on a workpiece by holding the workpiece with holding means and by putting a working tool in contact with the workpiece thus held, is improved according to the present invention in that: a working liquid is directed to the place at which the working tool is put in contact with the workpiece; and simultaneously a gas is ejected toward the workpiece in such a way that the working liquid may forcedly invade into the working tool-and-workpiece contacting area.

An agglomeration of abrasive grain may be used as a working tool. Then, the agglomeration of abrasive grain may be used as a whetstone, and a required machining may be to grind the workpiece.

The holding means may be a chuck table, and the workpiece may be a semiconductor wafer. The working liquid may be water, and the gas ejected from the gas ejecting means may be air. And the grinding may be to grind the surface of a semiconductor wafer. The abrasive grain may be a cutting blade and the required machining may be to cut the workpiece, or more specifically dice a semiconductor wafer.

The ejection of air has the effect of pushing the working liquid forcedly into the working tool-and-workpiece contacting area, thereby permitting the working liquid to invade effectively into the working tool-and-workpiece contacting area at an increased efficiency.

Other objects and advantages of the present invention will be better understood from the following description of preferred embodiments of the present invention, which are shown in accompanying drawings.

DESCRIPTION OF THE PREFERRED EMBODIMENTS

Figure 1:
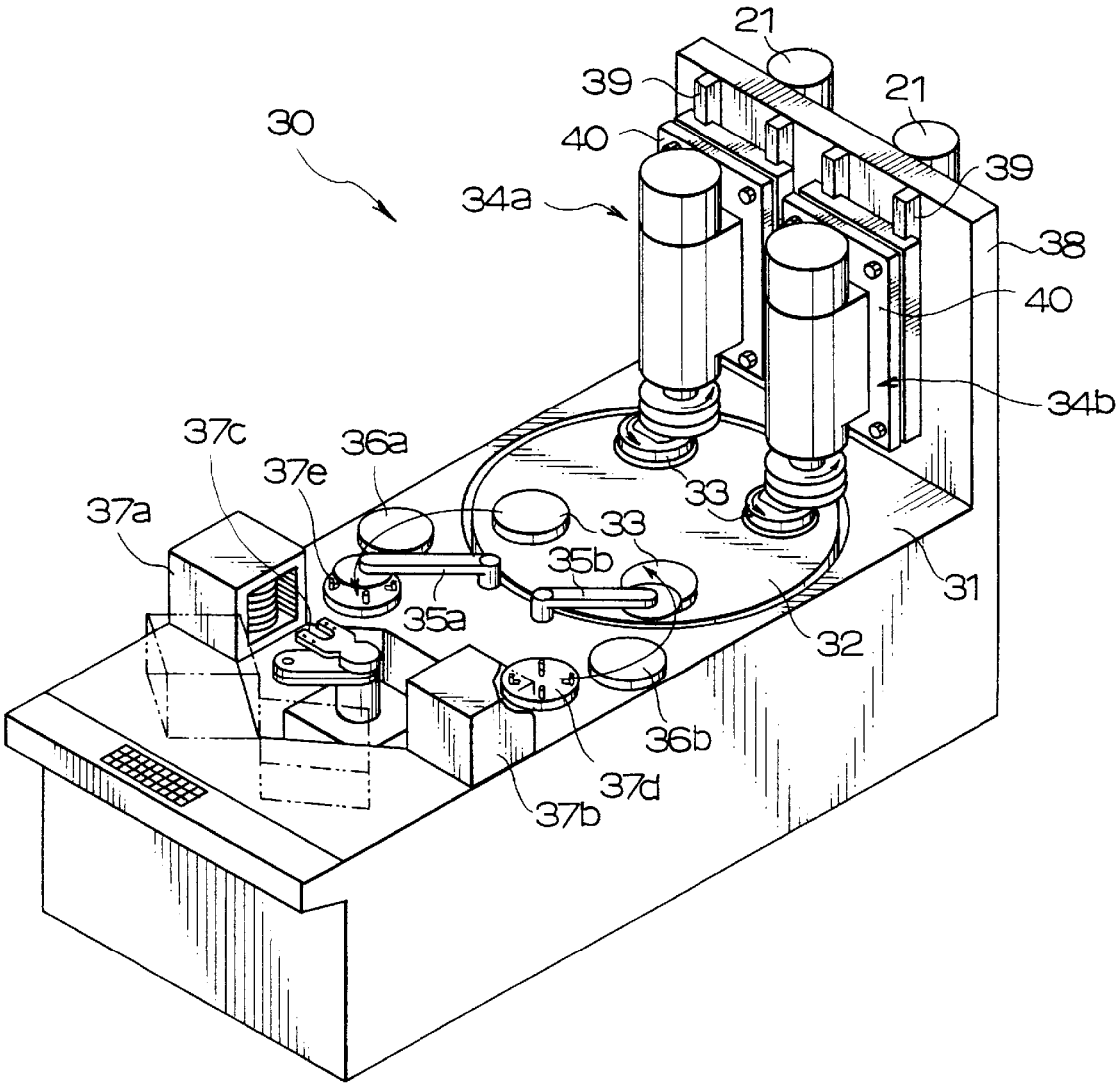
FIG. 1 is a perspective view of a machining apparatus according to a first embodiment of the present invention, which is given in the form of grinding apparatus.

FIG. 1 shows a grinding apparatus 30 according to a first embodiment of the present invention. Referring to FIG. 1 the manner in which a semiconductor wafer "W" can be ground while being exposed to the flushing of water and ejection of air is described below.

A selected semiconductor wafer to be ground is transferred from a first cassette 37*b* to a first centering table 37*d* by a first transporting means 37*c*. Then, the semiconductor wafer is transferred from the centering table 37*d* to a selected chuck table 33, which is on a turntable 32, and happens to be in the vicinity of the centering table 37*d*, by a second transporting means 35*b*. The chuck table 33 will be brought and put just below a grinding means 34*b* by rotating the turntable 32. When the turntable 32 rotates, the grinding whetstone of a first grinding means 34*b* while rotating is lowered until the grinding whetstone is pushed against the semiconductor wafer. Thus, the coarse grinding is effected on the semiconductor wafer.

Further turning of the turntable 32 brings the semiconductor wafer to a second grinding means 34*a*, and the grinding whetstone of the grinding means 34*a* is rotated and lowered until it is pushed against the semiconductor wafer. Thus, the fine grinding such as mirror-like finishing is effected on the semiconductor wafer.

The chuck table 33 bearing the ground semiconductor wafer is brought to the vicinity of a tentative storage station 36*a*. Then, by a second transporting means 35*a* the semiconductor wafer is put on the tentative storage station 36*a* for washing. After being washed there, the semiconductor wafer is brought to a second centering table 37*e*, and finally it is transported into a second cassette 37*a*.

As seen from FIG. 1, a wall 38 rises from the rear side of the working table 31. The wall 38 has two pairs of parallel rails 39 extending vertically thereon, and each pair of rails 39 has a slider 40 movably fixed thereon. Each slider 40 carries the first or second grinding means 34*a* or 34*b*. Each slider 40 is driven by a drive block (described later) positioned on the rear side of the wall 38, which is connected to one of two stepping motors 21 respectively.

Figure 2:
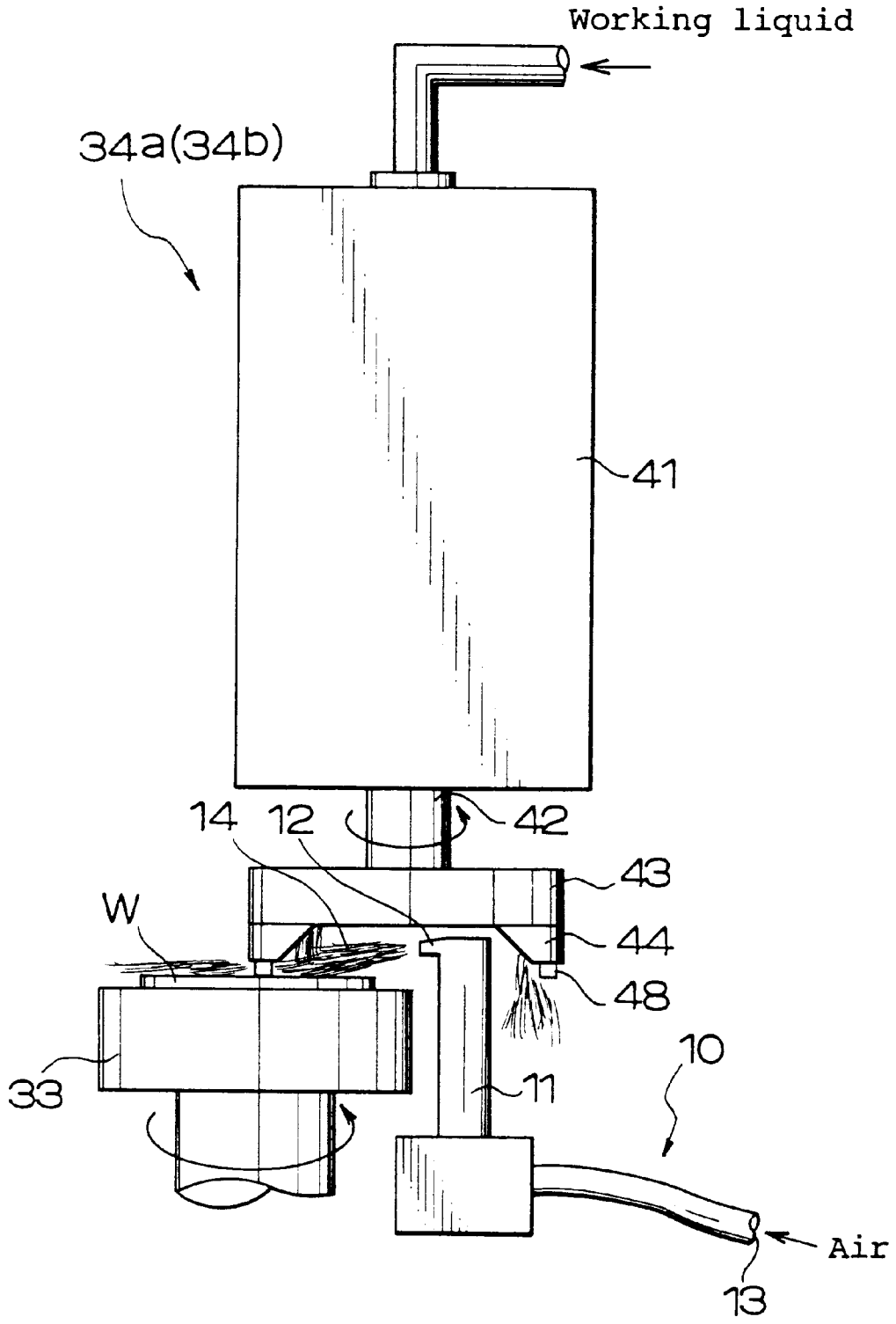
FIG. 2 illustrates the grinding means, the chuck table and the gas ejecting means of the grinding apparatus of FIG. 1.

As seen from FIG. 2, a spindle housing 41 has a spindle 42 rotatably fixed at its center, and the spindle 42 has a disc mount 43 on its bottom end. The disc mount 43 has a grinding wheel 44 fixed to its bottom. As seen from FIG. 6, the spindle 42 has channel 45 formed for working liquid to flow. This channel 45 extends radially to nozzle apertures 47 made on the circumference of the grinding wheel 44 via diverged ways 46 formed in the disc mount 43. Grinding whetstones 48 are fixed to the grinding wheel 44 outside of the nozzle apertures 47, to be used as working tool.

Figure 3A:
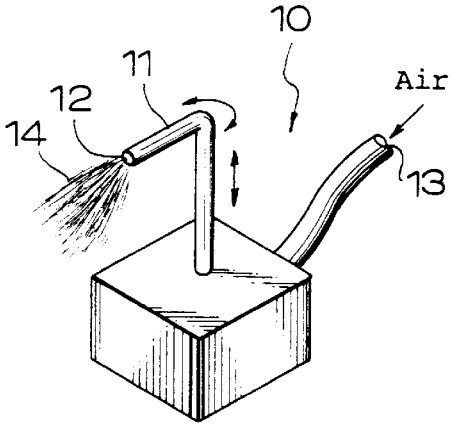
FIGS. 3A through 3C show different modes of gas ejecting means.
Figure 3B:
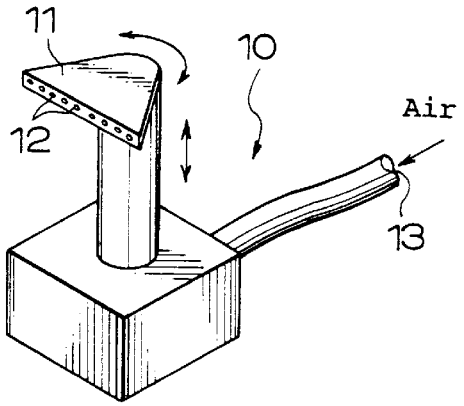
Figure 3C:
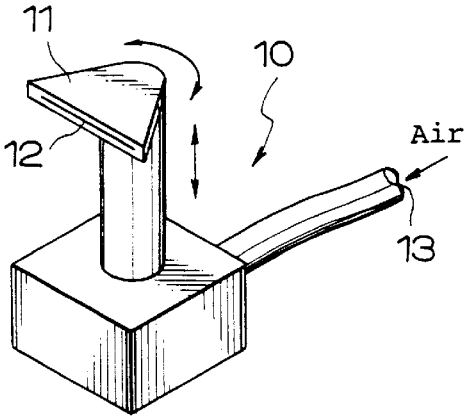

Gas ejecting means 10 rises from the working table 31 with its nozzle 11 directed toward the chuck table 33. As shown in FIG. 2, the gas ejecting means 10 is supplied with air at an increased pressure from an associated gas supply 13. Thus, a stream of high-pressure air 14 is ejected from the nozzle 12. As shown in FIG. 3(A), the gas ejecting means 10 may be so designed that a nozzle 11 having a single outlet 12 may be rotated and moved up and down, ejecting gas from the outlet 12; in FIG. 3(B), a nozzle 11 having a plurality of outlets 12 made in its divergent head may be rotated and moved up and down, ejecting gas from the outlets 12; or in FIG. 3(C), a nozzle 11 having a single horizontal slit 12 made in its divergent head may be rotated and moved up and down, ejecting gas from the horizontal slit 12.

Figure 4:
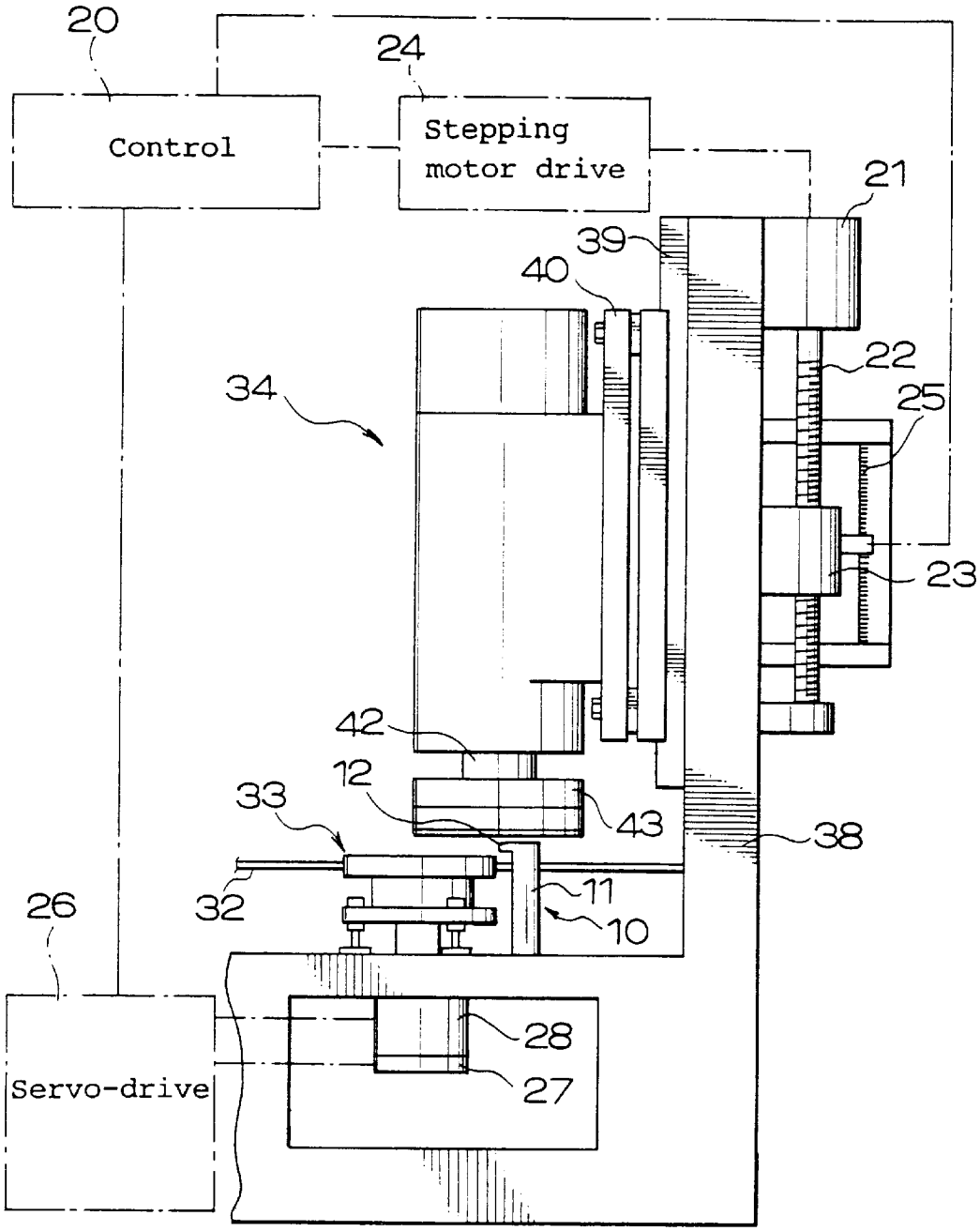
FIG. 4 is a general arrangement of main parts in the grinding apparatus of FIG. 1.

As shown in FIG. 4, the semiconductor grinding apparatus has a control 20 for controlling up-and-down movement of grinding means 34, rotation of the spindle 42 and rotation of the chuck table 33.

The stepping motor 21 on the rear side of the wall 38 is connected to an associated motor drive 24. The stepping motor 21 has a drive block 23 threadedly engaged with its threaded shaft 22. The drive block 23 is connected to the slider 40 on the front side of the wall 38. The control 20 permits driving of the stepping motor 21 via the associated motor drive 24, thereby moving the slider 40 up and down along the guide rails 39, and hence moving the grinding means 34 up and down on the front side of the wall 38.

A linear scale 25 extends vertically on the rear side of the wall 38 to determine the vertical location of the drive block 23 for informing the control 20 of the instantaneous position of the drive block 23. This arrangement permits the control 20 to effect a precision control on the up-and-down movement of the grinding means 34.

The chuck table 33 is equipped with an encoder 27 and a servomotor 28, and the control 20 is connected to the encoder 27 and the servomotor 28 of the chuck table 33 via a servo-driver 26 for controlling rotation of the chuck table 33.

In grinding a semiconductor wafer "W", which is firmly held on the chuck table 33, the chuck table 33 is rotated, and at the same time, the spindle 42 is rotated and the grinding means 34 is lowered to push the rotating grinding whetstone 48 against the semiconductor wafer "W". Thus, the semiconductor wafer "W" is subjected to grinding. At the same time the water as working liquid is allowed to flush to the wafer "W" from the apertures 47 by thrusting water 15 in the water channel 45 and the diverged ways 46.

Figure 5:
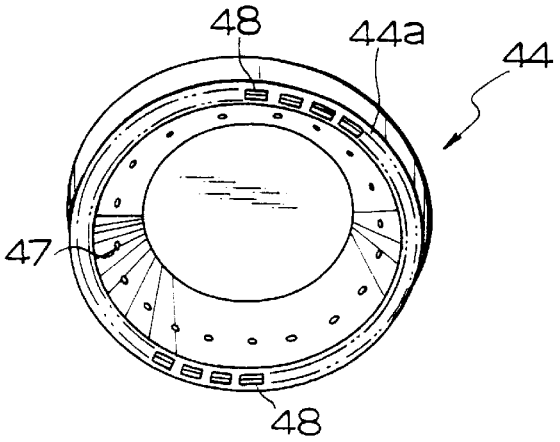
FIG. 5 illustrates a grinding wheel to be used in the grinding apparatus.

As best seen from FIG. 5, the grinding wheel 44 has a plurality of water-ejecting apertures 47 made at regular intervals circumferentially on its circular base 44*a*, and a plurality of grinding whetstones 48 encircling the water-ejecting apertures 47. The disc mount 43 is bolted to the top side of the grinding wheel 44.

Figure 6:
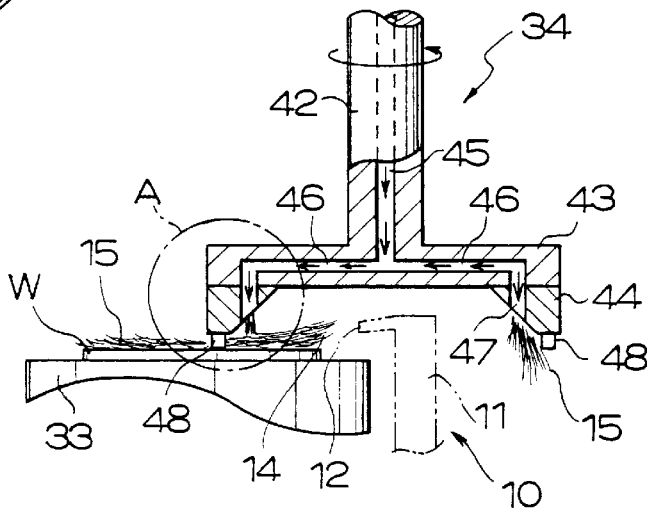
FIG. 6 illustrates how a semiconductor wafer is ground while exposed to the flushing of water and ejection of gas.

As best seen from FIG. 6, in grinding semiconductor wafers by the grinding apparatus 30 each semiconductor wafer "W" is put on the respective chuck table 33 to be firmly fixed thereon. Then, the chuck table 33 is rotated, and the spindle 42 and hence the grinding wheel 44 is rotated while permitting the descending of the grinding means 34 until the grinding whetstones 48 are pushed against the semiconductor wafer "W" with an appropriate strength of pressure. All of these are controlled by the control 20.

Distilled water is supplied to the water channel 45 at the rate of 0.4 liters per minute for flushing from the apertures 47 of the grinding wheel 44 via diverged ways 46 to a selected semiconductor wafer "W".

At the same time a gas is supplied to the gas ejecting means 10 to eject the gas from the nozzle 12 preferably at the pressure of 3 to 5 atmospheres at the rate of 5 to 20 liters per minute. Lubricating oil may be used in place of distilled water. Air may be replaced by inert gas. A liquid-and-gas mixture may be used, and then, the liquid will spread like mist.

Figure 7:
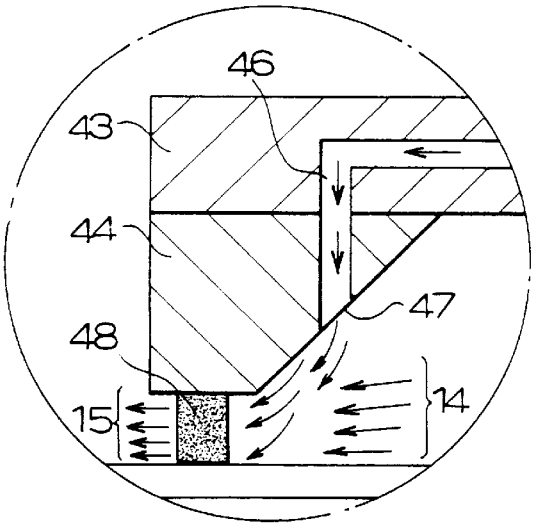
FIG. 7 is an enlarged view of the portion indicated by a circle A in FIG. 6.

As shown in FIG. 7, thanks to the ejected air the working liquid 15 is made to flow at an increased speed to invade forcedly into the semiconductor-and-whetstone contacting place, thereby expediting the cooling of the semiconductor wafer "W". The cooling effect can be amplified by vaporization of working liquid, thereby depriving the semiconductor of heat for vaporization.

Thus, face burn of the semiconductor can be prevented even though the working liquid is made to flush at a relatively small rate, for example at the rate of 0.4 liters per minute. Experimental results revealed that: 300 semiconductor wafers were ground without being damaged by face burn when air was blowing according to the present invention whereas the grinding was found impossible in the course of grinding the second semiconductor when no air-blowing was used. Working liquid must be supplied at the rate of 2 liters per minute when no air-blowing is used.

The forced invasion of air and water into the wafer-and-whetstone contacting place has the effects of: preventing appearance of cracks or distortions in the ground semiconductor wafer; making it possible to accomplish the mirror-like grinding of semiconductor wafer; and permitting the semiconductor wafer to be grounded to be thin 200 $\mu$m or below without lowering the rotating speed of the spindle 42.

Figure 8:
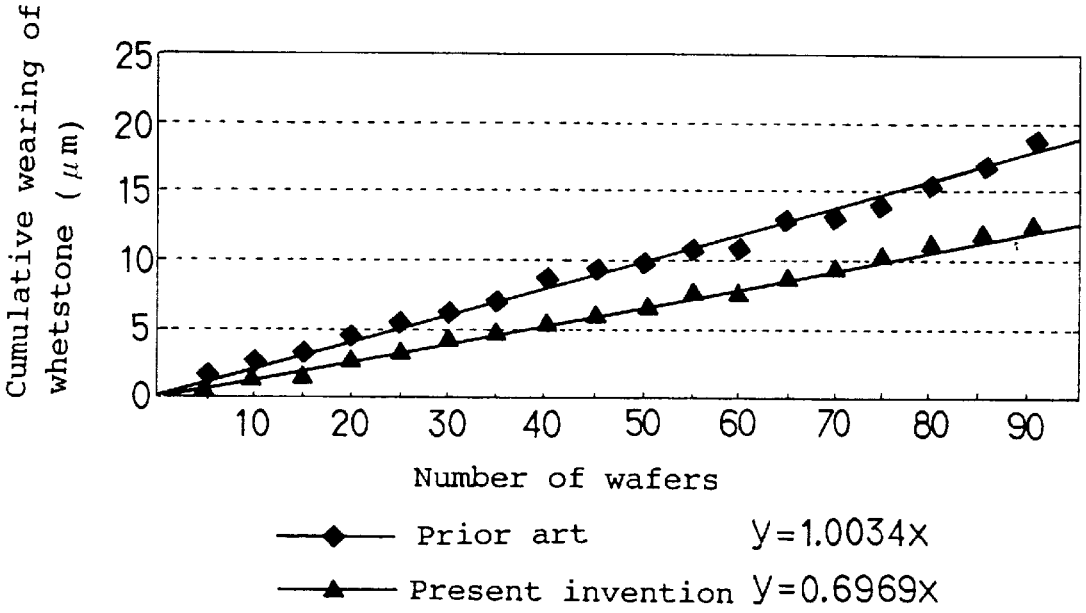
FIG. 8 is a graphic representation showing how the wear of whetstone varies with the number of semiconductor wafers to be ground.

Also advantageously, the whetstone 48 can have an elongated life because of least wearing, which is caused by forced invasion of air and water into the wafer-and-whetstone contacting place. FIG. 8 shows the wearing of whetstone 48 without using forced air as in the conventional grinding method using cooling water only, and the wearing of whetstone 48 when using air ejection 14 toward wafer-and-whetstone contacting place according to the present invention.

As seen from the graphic representation, in either case the wearing of whetstone (ordinates) is likely to increase linearly with the number of semiconductor wafers (abscissa). The gradient of the wearing curve in case of using air-blowing is 0.69 whereas the gradient of the wearing curve in case of using no air-blowing is 1.0034. The wearing is reduced about 30 percent by using air-blowing. Stated otherwise, the life of the grinding whetstone is extended 30 percent.

Figure 9:
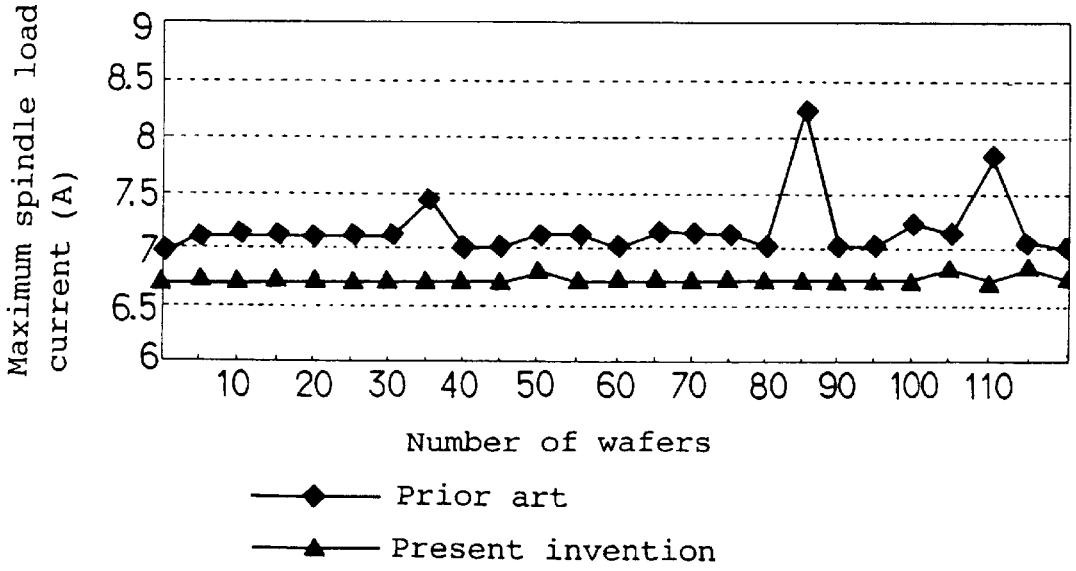
FIG. 9 is a graphic representation showing how the spindle: load current varies with the number of semiconductor wafers to be ground.

To prevent the rotating speed of the spindle 42 from descending by the occasional increase of friction between the grinding whetstone 48 and the semiconductor wafer "W" it is usually necessary to increase the electric current to the motor for driving the spindle. The forced invasion of working water into the wafer-and-whetstone contacting place has the effect of keeping the friction at the contacting place at a relatively small value. This was realized from the experiment results, which reveal that a minimum quantity of additional electric current is required, as seen from FIG. 9. The graphic representation of the number of wafers to be ground (abscissa) relative to the additional electric current (ordinates) shows that: the additional electric current can be reduced approximately by 0.7 amperes in mean value; and there appears no sudden rise in the additional electric current because of even wearing of the whetstone 48 in the course of grinding. Thus, additional electric current remains substantially stable.

Figure 14:
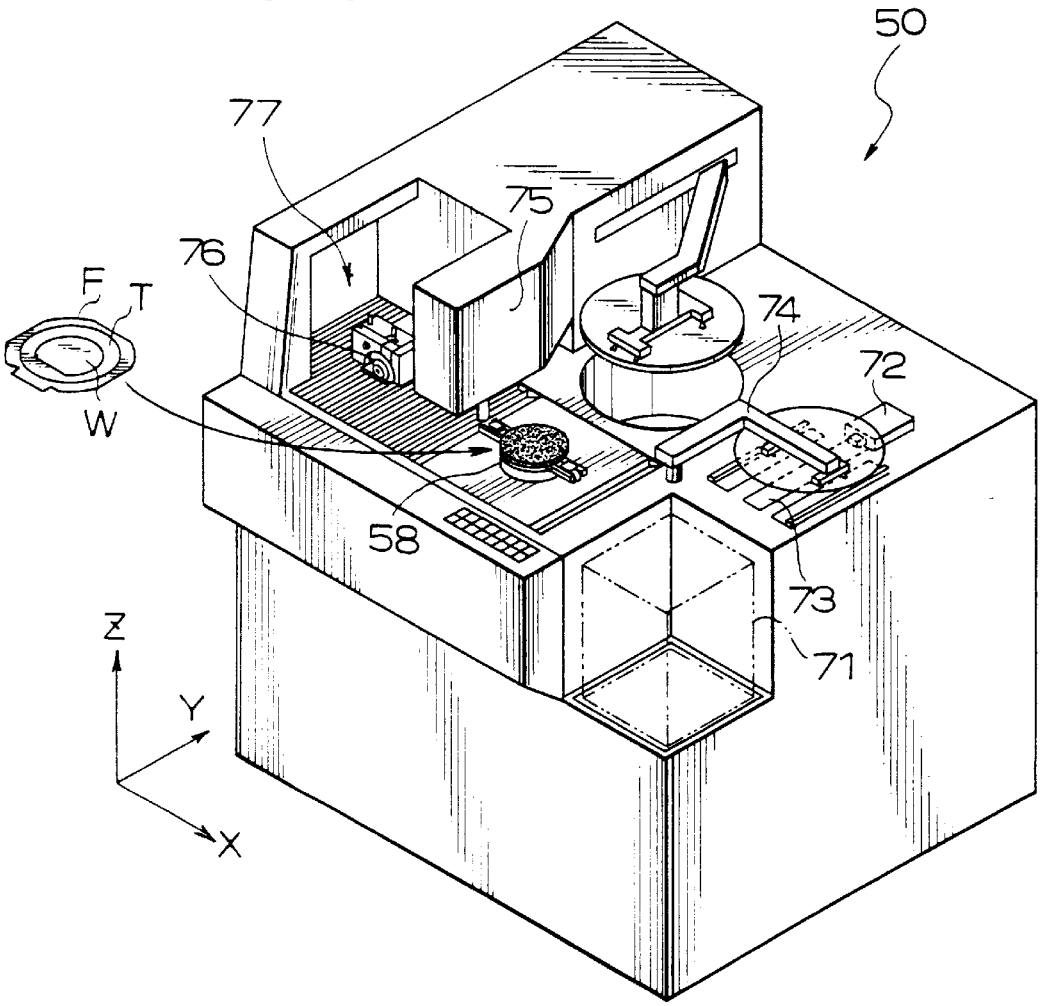
FIG. 14 is a perspective view of a conventional dicing apparatus.
Figure 15:
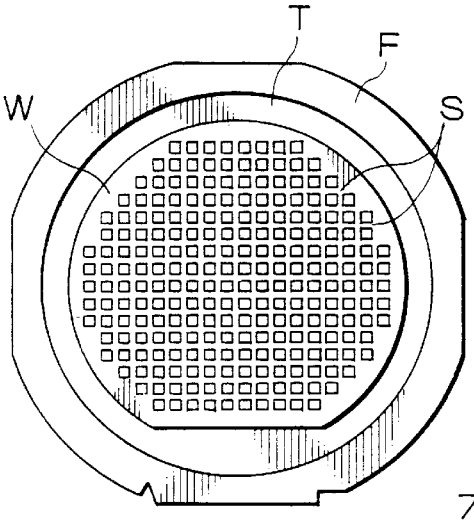
FIG. 15 is a plane view of a framed semiconductor wafer.
Figure 16:
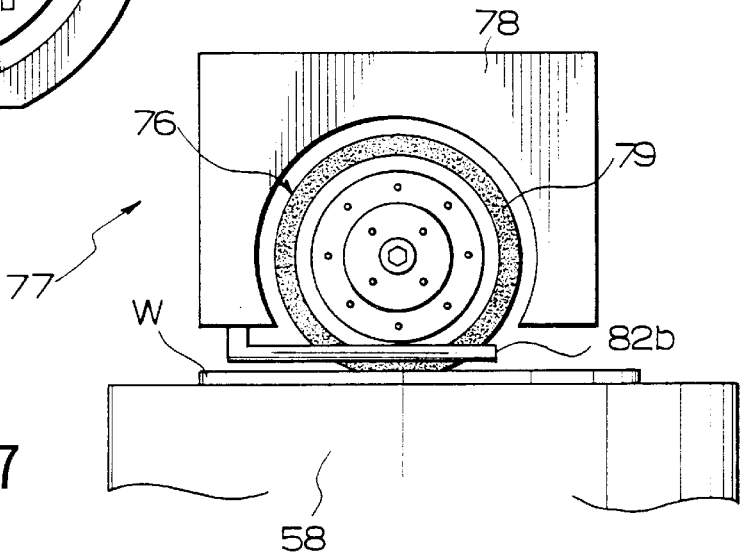
FIG. 16 illustrates a conventional cutting means in the dicing apparatus.
Figure 17:
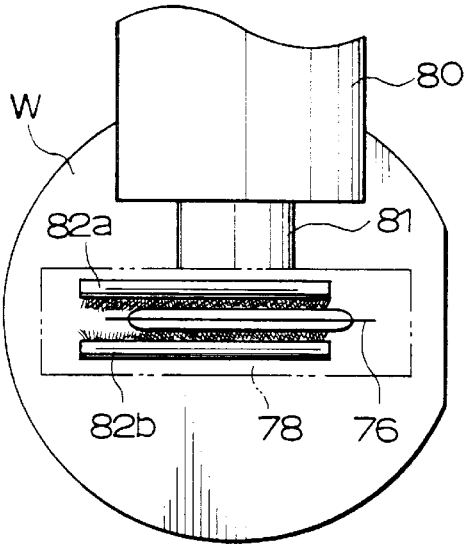
FIG. 17 illustrates the water-flushing and cutting structure, showing the manner in which a semiconductor wafer is diced while exposed to the flushing of water.

Now, a dicing apparatus according to the second embodiment; of the present invention, and the manner in which semiconductor wafers are subjected to dicing in the dicing apparatus are described below. The dicing apparatus according to the present invention is different from the conventional dicing apparatus 50 as shown in FIG. 14 only in dicing structure, and therefore, the other parts other than the dicing structure are indicated by same reference numerals as used in describing the conventional dicing apparatus, and descriptions of same parts are omitted.

Figure 10:
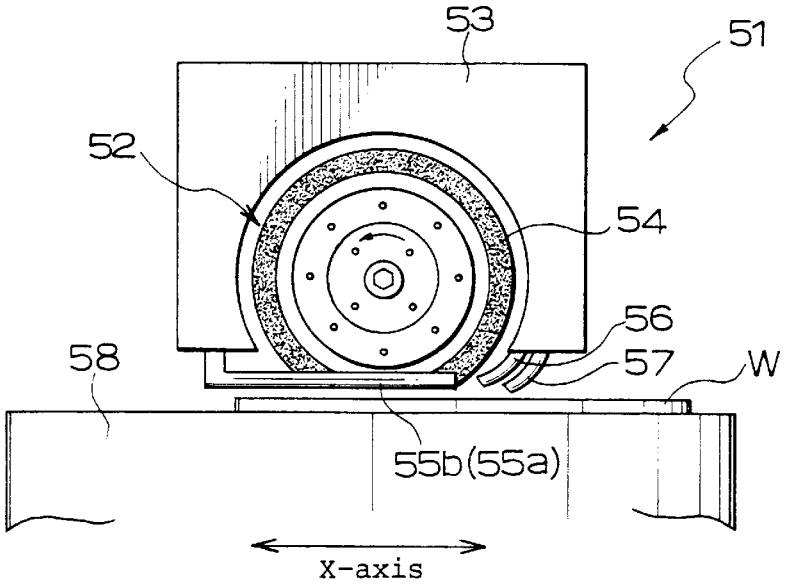
FIG. 10 shows a machining apparatus according to a second embodiment of the present invention, which is given in the form of dicing apparatus.

As seen from FIG. 10, the cutting means 51 has a cutting blade 52 covered with a blade cover 53. The cutting blade 52 has agglomeration of abrasive grain on its circumference 54 formed with pulverized diamond et al by electro forming. Also, the blade cover 53 has cutting liquid nozzles 55*a* and 55*b* arranged at equal distance from the opposite sides of the cutting blade 52 to be used as working liquid supplying means, as seen from FIG. 11.

An another cutting liquid nozzle 56 is placed on the line extending from the cutting blade 52 for directing the flushing of working liquid to the place at which the cutting blade 52 is put in contact with the semiconductor wafer "W", and a high-pressure air ejecting means 57 is placed behind the cutting liquid nozzle 56.

In cutting the semiconductor wafer "W" with the so constructed cutting means 51 the cutting liquid nozzle 56 starts the flushing of cutting liquid such as water, and at the same time, the chuck table 58 carrying a semiconductor wafer is moved in the X-direction, thereby permitting rotating of the cutting blade 52 to cut the semiconductor wafer along a selected line in the lattice pattern.

Figure 11:
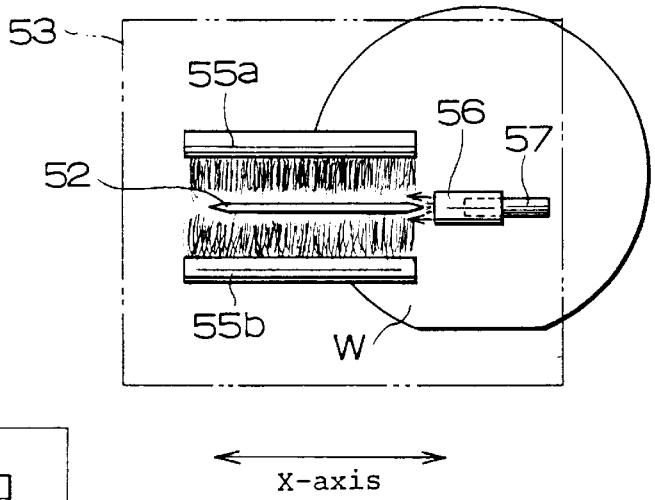
FIG. 11 illustrates a first example of water-flushing and gas-ejecting structure, showing the manner in which a semiconductor wafer is diced while exposed to the flushing of water and ejection of gas.

As seen from FIG. 11, the cutting liquid is ejected from the cutting liquid nozzles 55*a* and 55*b* to the place at which the cutting blade 52 is put in contact with the semiconductor wafer "W", and also the cutting liquid is ejected from the nozzle 56 to the same contacting place. The ejected water is converged to the wafer-and-blade contacting place under the influence caused by air-ejection from the high-pressure air ejecting means 57, thus making the water to forcedly invade into any gap left between the semiconductor wafer "W" and the cutting blade 52. Thus, the cooling effect is expedited. Additionally evaporation of water is expedited by the ejecting air, still increasing the cooling effect by depriving the wafer-and-blade interface of heat.

Such amplified cooling effect is found to be most effective in preventing appearance of cracks or chippings in dicing a semiconductor wafer, and improving the machining precision and accordingly the quality of resultant chips.

Figure 12:
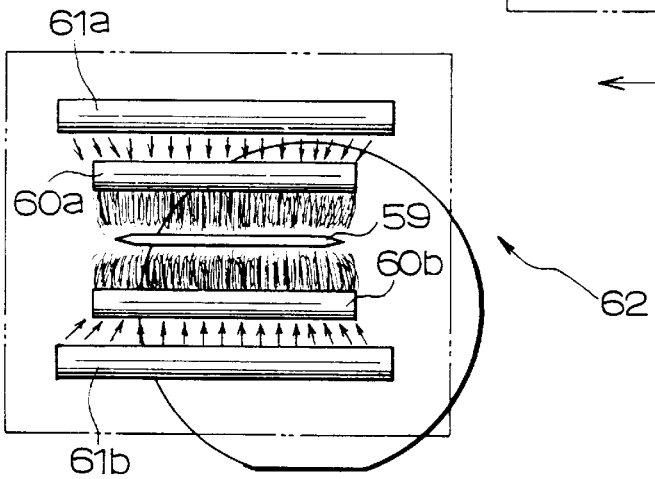
FIG. 12 illustrates a second example of water-flushing and gas-ejecting structure, showing the manner in which a semiconductor wafer is diced while exposed to the flushing of water and ejection of gas.
Figure 13:
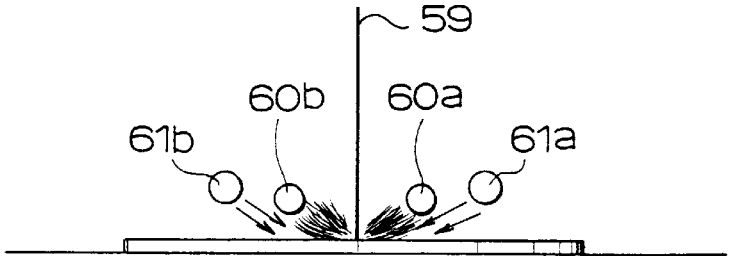
FIG. 13 illustrates the second example of water-flushing and gas-ejecting structure, showing the grinding operation as viewed from an angle different from FIG. 12.

FIGS. 12 and 13 show a modification of cutting means. As shown, two cutting liquid nozzles 60*a* and 60*b* are arranged at equal distance from the opposite sides of the cutting blade 59, and two gas ejecting nozzles 61*a* and 61*b* are arranged at equal distance from the cutting liquid nozzles 60*a* and 60*b*. Each gas ejecting nozzle 61*a* or 61*b* has numerous air ports (not shown) made therein.

In operation air is ejected from the gas ejecting nozzles 61*a* and 61*b* while water is being supplied to the cutting liquid nozzles 60*a* and 60*b*, and then, the working liquid is made to converge toward either side of the wafer-and-blade place. Thus, the working liquid is made to invade the wafer-and-blade interface even more forcedly than the cutting means of FIG. 11, and accordingly the cooling effect can be increased still more. This contributes to further improvement in machining precision and the quality of chips.

A machining apparatus according to the present invention is described above as grinding and dicing apparatuses, but it is apparent to those skilled in the art that the present invention can be equally applied to machining apparatuses other than these embodiments, as for instance follows: a shaft grinder for grinding the surface of cylindrical iron rods; a planer for machining stone, glass or metal objects; a cutter for cutting different hard materials; a semiconductor ingot cutter for slicing semiconductor ingots, and the like.

Examples of working tools to be used in such machining apparatuses are wheels of pulverized natural or man-made diamond, and of agglomeration of CBN, carborundum, alundum particles and other abrasive grains, all solidified by using vitrified bond, metal bond, resinoid bond or by electrolytic deposition or electro forming.

If the machining apparatus is installed in a closed space such as a clean room, preferably air is used as ejecting gas; an inert gas if used, may cause an adverse effect on operators' breathing.

The machining method and apparatus according to the present invention has following advantages: the forced invasion of air into the wafer-and-whetstone interface has the effect of permitting the working liquid to be supplied to the interface at an increased efficiency, and of expediting the vaporization of working liquid to deprive the interface of heat, thus amplifying the cooling effect;

the feeding quantity of working liquid can be decreased to 20 percent of usual or less, still assuring the comparable machining quality. The workpiece can be ground to a minimum possible thickness as could not have been ever attained, that is, 200 $\mu$m or below. Mirror-like polishing can be attained, also. Friction between the workpiece and the whetstone is reduced, and accordingly the wearing of the whetstone is reduced, resulting in elongation of life of the whetstone;

In dicing a semiconductor wafer the improved cooling effect caused by the forced invasion of air into the wafer-and-whetstone interface eliminates effectively cracks or chippings which otherwise, would appear on the opposite sides of a selected cutting line in the lattice of the semiconductor wafer, thus providing chips of high quality; and In all machining apparatuses of the type supplying a working liquid to the machining tool the working liquid can be substantially saved, thereby solving the environmental problem and the economical problem simultaneously, still assuring that the products of comparable or even higher quality are provided.

What is claimed is:

1. A method for grinding of a semiconductor wafer in which a required grinding is effected by using a machining apparatus comprising a holding means for holding the semiconductor wafer to be ground, a machining means having a whetstone put in contact with the semiconductor wafer held by the holding means for effecting a required grinding, working water supplying means for directing a working water to the place at which the whetstone is put in contact with the semiconductor wafer, at a contacting area, and gas ejecting means for ejecting a gas toward the semiconductor wafer, wherein the method comprises the steps of:

disposing a gas ejection nozzle of the gas ejecting means in the direction toward the whetstone and semiconductor wafer contacting area:

directing the working water to the place at which the whetstone is put in contact with a surface of the semiconductor wafer and simultaneously ejecting the gas from the gas ejection nozzle in such a way that the gas, in a stream of high-pressure, gas may push the working water forcedly through the whetstone and semiconductor wafer contacting area.

* * * * *